US010702998B2

(12) United States Patent
Baltussen et al.

(10) Patent No.: US 10,702,998 B2
(45) Date of Patent: Jul. 7, 2020

(54) LENGTH ADJUSTMENT MECHANISM FOR A HAIR CUTTING APPLIANCE

(71) Applicant: KONINKLIJKE PHILIPS N.V., Eindhoven (NL)

(72) Inventors: Henricus Wilhelmus Johannes Baltussen, Eindhoven (NL); Kin Fatt Phoon, Eindhoven (NL); Ishay Halmut, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/065,926

(22) PCT Filed: Jan. 3, 2017

(86) PCT No.: PCT/EP2017/050043
§ 371 (c)(1),
(2) Date: Jun. 25, 2018

(87) PCT Pub. No.: WO2017/121655
PCT Pub. Date: Jul. 20, 2017

(65) Prior Publication Data

US 2019/0009418 A1 Jan. 10, 2019

(30) Foreign Application Priority Data

Jan. 12, 2016 (EP) ..... 16150919

(51) Int. Cl.
*B26B 19/20* (2006.01)
*B26B 19/38* (2006.01)

(52) U.S. Cl.
CPC ..... *B26B 19/20* (2013.01); *B26B 19/3806* (2013.01); *B26B 19/3826* (2013.01); *B26B 19/3886* (2013.01)

(58) Field of Classification Search
CPC ..... B26B 19/20; B26B 19/205; B26B 19/00
USPC ..... 30/200, 201
See application file for complete search history.

(56) References Cited

U.S. PATENT DOCUMENTS 1,869,101 A * 7/1932 Henderson ..... B26B 19/20 30/200
5,050,305 A 9/1991 Baker
5,084,974 A * 2/1992 Sukow ..... B26B 19/20 30/201
5,979,060 A 11/1999 Holzbauer
6,968,623 B2 11/2005 Braun et al.
(Continued)

FOREIGN PATENT DOCUMENTS

CH 133867 A * 6/1929 ..... B26B 19/20
DE 3727482 A1 3/1989
(Continued)

*Primary Examiner* — Jennifer B Swinney

(57) ABSTRACT

A length adjustment mechanism for an adjustable comb for a hair cutting appliance includes at least one first sliding joint defining a first movement direction, and at least one second sliding joint defining a second movement direction. The first and second movement directions are arranged in a non-parallel fashion in such a way that a coupling link engaging the first and second sliding joints is guided between a first position and a second position for a combined longitudinal and swiveling movement therebetween.

20 Claims, 5 Drawing Sheets

(56) References Cited

U.S. PATENT DOCUMENTS

| | | | | |
|---|---|---|---|---|
| 2004/0250429 | A1* | 12/2004 | McCambridge | B26B 19/20 30/233.5 |
| 2008/0172885 | A1 | 7/2008 | Morisugi | |
| 2009/0188117 | A1* | 7/2009 | Putzer | B26B 19/20 30/201 |
| 2011/0107604 | A1 | 5/2011 | Julemont | |

FOREIGN PATENT DOCUMENTS

| | | | |
|---|---|---|---|
| EP | 1493539 | A1 | 1/2005 |
| EP | 2500153 | A2 | 9/2012 |
| WO | 20010779 | A1 | 3/2000 |
| WO | 2013080114 | A1 | 6/2013 |
| WO | 2015169633 | A1 | 11/2015 |

* cited by examiner

II

I

LENGTH ADJUSTMENT MECHANISM FOR A HAIR CUTTING APPLIANCE

This application is the U.S. National Phase application under 35 U.S.C. § 371 of International Application No. PCT/EP2017/050043, filed on Jan. 3, 2017, which claims the benefit of European Application No. 16150919.5 filed on Jan. 12, 2016. These applications are hereby incorporated by reference herein.

FIELD OF THE INVENTION

The present disclosure relates to a length adjustment mechanism for a hair cutting appliance and to a cutting head assembly for a hair cutting appliance. The present disclosure further relates to a hair cutting appliance, particularly an electrically powered trimmer, the appliance comprising an adjustment mechanism arranged for actuating an adjustable comb thereof.

BACKGROUND OF THE INVENTION

Hair cutting appliances, particularly electric hair cutting appliances, are generally known and may include trimmers, clippers and shavers. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to trim or remove (human) body hair, in particular facial hair and head hair to allow a person to have a well-groomed appearance. Frequently, electric hair cutting appliances are used for cutting animal hair.

U.S. Pat. No. 6,968,623 B2 discloses a hair trimmer comprising a body, a cutting head including a blade set, an adjustable comb, wherein the comb is movable with respect to the blade set, an electric motor for driving the blade set to effect a cutting action, and an actuator assembly that is capable of moving the comb with respect to the blade set between a fully retracted position and a fully extended position, the actuator assembly comprising a comb carriage, a comb button connected to the comb carriage, wherein the comb button is actuatable to adjust the position of the comb relative to the blade set, and a lock button movable with respect to the comb button, wherein the lock button selectively prevents and permits movement of the comb button relative to the body. Consequently, manual adjustment of the length of the comb is enabled.

A comb for a hair cutting appliance, particularly a spacing comb, generally may be arranged as an attachable comb or an integrally formed comb. A spacing comb generally spaces a blade set of the hair cutting appliance away from the skin when the appliance is moved in a moving direction with respect to the skin during operation. Consequently, the spacing comb may enable to process/cut hair to a desired length, i.e. to a desired length of remaining hair at the skin.

Conventional hair cutting appliances may be fitted with a set of attachment combs, each of which associated with a distinct hair length. Consequently, a user of the appliance basically needs to replace an attachment comb by another one to alter the hair cutting length. Furthermore, manually adjustable comb attachments are known, as disclosed in U.S. Pat. No. 6,968,623 B2. Furthermore, also powered adjustment combs have been presented in recent years, as for instance disclosed in EP 2 500 153 A2. Typically, powered adjustment combs comprise a movable comb portion that is movable with respect to a blade set of the hair cutting appliance, wherein the movable comb portion is coupled to an actuator, particularly to an electromotor and/or an electric powertrain.

Length adjustment mechanisms of a conventional mechanical kind typically transfer or convert a manual operating movement applied by the user into a resulting adjustment movement. It has been observed that, for small length values, a rather fine-graduated length adjustment is desired. By contrast, for rather large hair length values, a coarse-graduated length setting is desirable. Hence, conventional length adjustment mechanisms typically represent a tradeoff between a capability of fine adjustment and a quick user-friendly adjustment setting.

There is thus room for improvement in length adjustment mechanisms.

SUMMARY OF THE INVENTION

In view of the above, it is an object of the present invention to seek for alternative length adjustment mechanisms which enable, on the one hand, a finely graduated length adjustment. On the other hand, easy-to-operate and quick-adjustment aspects shall be addressed. Further, a length adjustment mechanism shall be presented which is easy to manufacture and to assemble and which preferably requires only a small number of parts. Furthermore, it would be desirable to present a length adjustment mechanism which allows for a simplified length adjustment operation, preferably for one-hand operation and adjustment. Further, it would be desirable to present a length adjustment mechanism exhibiting a certain movement conversion characteristic addressing at least one of the above-indicated issues.

Furthermore, a cutting head assembly for a hair cutting appliance shall be presented which includes a respective length adjustment mechanism and which is arranged to cooperate with an adjustable comp for length adjustment. Preferably, the adjustment comb, when being attached to the cutting head assembly of the hair cutting appliance, is also automatically coupled with the length adjustment mechanism.

It is also desirable to provide a respective hair cutting appliance arranged for receiving an adjustable comb which is arranged to be adjusted by a length adjustment mechanism as discussed herein.

In a first aspect of the present invention, a length adjustment mechanism for an adjustable comb for a hair cutting appliance is presented, the mechanism comprising:

- at least one first sliding joint defining a first movement direction, and
- at least one second sliding joint defining a second movement direction, wherein the first movement direction and the second movement direction are arranged in a non-parallel fashion in such a way that a coupling link engaging the first sliding joint and the second sliding joint is guided between a first position and a second position for a combined longitudinal and swiveling movement therebetween.

This aspect is based on the insight that a linkage mechanism showing a desired movement characteristic may be provided so as to convert an input movement into a resulting movement of the adjustable comb. In accordance with the above aspect, a coupling link is provided which is associated with the adjustable comb. Preferably, the coupling link forms an integral portion of the adjustable comb. The coupling link may comprise two coupling elements one of which forms part of the first sliding joint, whereas the other one forms part of the second sliding joint. Consequently, a forced or restricted guidance for the coupling link may be provided in such a way that an input actuating movement, e.g., at the first sliding joint is converted into a resulting adjustment movement of the adjustable comb. As discussed above, the adjustable comb may be also referred to as adjustable spacing comb.

The adjustable comb may be arranged as a releasably attachable comb. However, in some embodiments, the adjustable comb may form a non-releasable component of the hair cutting appliance.

The adjustable comb is arranged for length adjustment. As used herein, length adjustment relates to hair length adjustment. Typically, the adjustable comb defines an offset between a cutting portion or blade set and a skin portion or head portion which results in a corresponding remaining hair length after the hair cutting or trimming operation.

The first movement direction and the second movement direction differ from one another. In accordance with the above aspect, the first sliding joint defines a first movement direction and the second sliding joint defines a different, second movement direction. Consequently, the coupling link engaging both, the first sliding joint and the second joint may be displaced between the first position and the second position in a combined movement which may include a translation and a rotation or pivoting component.

Consequently, also the adjustable comb may be moved in a combined translation/swiveling movement. This may have the advantage that a non-linear conversion characteristic may be achieved. For instance, a progressive or degressive conversion characteristic may be achieved.

This may for instance involve that a certain input movement increment causes a small response in a first state (e.g. adjacent to the first position). By contrast, the same input movement increment may cause a larger response (amplified response) in a second state (e.g. in the vicinity of the second position).

For instance, a swiveling movement of the adjustable comb may be superimposed on a base longitudinal movement. Consequently, a first state may be defined wherein a fine-graduated length adjustment is enabled wherein a coarse-adjustment or a high transmission ratio is achieved in a second state.

Needless to say, a transition may be defined between the first state and the second state. Further, it is not necessarily required to define discrete states wherein a constant ratio is provided. Rather, a respective ratio of the motion conversion characteristic may be non-steady along the travel path of the comb.

For instance, an exemplary setting of length adjustment values may involve the following (hair) length values: 1.0 mm (millimeters); 1.5 mm; 3.0 mm; 5.0 mm; 8.0 mm; 12.0 mm; 18.0 mm, and 25.0 mm. Consequently, the step size of the set of length values is non-steady but rather increased, starting from small length values towards large length values. Needless to say, the above shall not be interpreted in a limiting sense but rather regarded as an exemplary length setting. Provided that a respective adjustment operation can be induced by basically constant input operations, a greatly simplified quick adjustment operation is achieved.

In an additional, supplemental aspect of the disclosure, a cutting length adjustment mechanism for a hair cutting appliance having an adjustable comb and a cutting head including a blade set is presented, the mechanism comprising at least one first sliding joint defining a first movement direction of the adjustable comb relative to the blade set, and at least one second sliding joint defining a second movement direction of the adjustable comb relative to the blade set, wherein the first movement direction and the second movement direction are arranged in a non-parallel fashion in such a way that a coupling link engaging the first sliding joint and the second sliding joint is guided between a first position and a second position for a combined movement therebetween. Preferably, a non-linear length setting characteristic, particularly an amplified, progressive-scale length setting characteristic, is provided in this way. The combined movement typically includes a longitudinal component and a swiveling component.

While main aspects of the present disclosure are presented and discussed herein in connection with a mechanical, manually operated length adjustment mechanism, this shall not be interpreted in a limiting sense. Rather, also powered length adjustment arrangements may profit from a respective length adjustment mechanism as discussed herein.

Preferably, the first movement direction and the second movement direction are arranged at an angular offset from one another. Provided that the respective coupling elements (also referred to as slide elements) of the coupling link are arranged at a fixed distance from one another, the coupling link (e.g. a bar between the coupling elements) as such is longitudinally and rotatingly moved between the first position and the second position.

Consequently, not only the position but also the orientation of the coupling link and, as a consequence, also of the adjustable comb, is changed when the coupling link is moved between the first position and the second position. This may have the advantage that not only the length setting is adjusted but also that an offset angle between the blade set of the hair cutting appliance and the contacted skin or head portion is adapted. It has been observed that a desired angular orientation of the appliance with respect to the skin may vary, depending on a currently selected cutting length. Hence, in accordance with the above embodiment, operating the hair cutting appliance, particularly when operating the appliance at relatively large length settings, may be significantly simplified.

At least in some exemplary embodiments, a set or arrangement including a respective adjustment mechanism and an adjustable comb is provided. For instance, the adjustment mechanism may form or define an interface or coupling link between the adjustable comb and a cutting head assembly of a hair cutting appliance.

In one embodiment of the adjustment mechanism, a pair of first sliding joints and a pair of second sliding joints is provided, wherein respective ones of the first sliding joints and the second sliding joints are arranged at a first lateral side and a second lateral side of a cutting head of the appliance. Consequently, parallel guidance for the adjustable comb may be provided.

Preferably, the adjustable comb is arranged as an attachment comb which may be attached to the cutting head in a click-on or snap-on fashion. In a corresponding embodiment, engagement elements of the adjustable comb which are provided for mounting the adjustable comb to the cutting head, may engage the first sliding joint and the second sliding joint. Consequently, in accordance with this embodiment, the length adjustment mechanism, particularly the sliding joints thereof, also serve as mounting features for the attachment of the comb at the cutting head.

In another embodiment of the adjustment mechanism, the coupling link is attached to, or an integrally formed (integrated, non-detachable) portion of, the adjustable comb, wherein the adjustable comb is movable, by means of the adjustment mechanism, between a retracted position and an extracted position, wherein a first angular setting is present in the retracted position, and wherein a second angular setting is present in the extracted position. Hence, the first position may be referred to as retracted position. The second position may be referred to as extracted position. Consequently, the position and the orientation of the adjustable comb with respect to the cutting head are changed between the first position and the second position. Needless to say, respective intermediate positions may be present in which an intermediate angular setting and a corresponding intermediate length setting is present.

In yet another embodiment, the adjustment mechanism comprises a driving slider associated with one of the first sliding joint and the second sliding joint, wherein the driving slider is arranged to actuate the adjustable comb so as to define an offset between a frontal end of the adjustable comb and a frontal end of a blade set of the hair cutting appliance, where the actuation of the adjustable comb involves a transmission, between a driving movement of the driving slider and a resulting adjustment movement of the adjustable comb, wherein a first transmission ratio is present at the first position and a second transmission ratio is present at the second position, wherein the second transmission ratio is larger than the first transmission ratio.

Both, the first sliding joint and the second sliding joint may define a respective movement path. The movement path of the first sliding joint and the second sliding joint are different from one another and particularly arranged at an angular offset. However, also basically parallel sections of the first sliding joint path and the second sliding joint path may be present. Further, at least one of the first sliding joint and the second sliding joint may define a somewhat curved path including at least one of a constant section, a ramp section, a curved section, and a transmission section therebetween.

Consequently, the transmission ratio may be a non-constant unsteady transmission ratio. By defining the respective paths of the first sliding joint and the second sliding joint, a desired movement transmission characteristic may be achieved.

In one embodiment of the adjustment mechanism, the first sliding joint involves a guide slot arranged at a cutting head housing, wherein a first slide element of the coupling link is provided which is movably received at (or in) the guide slot. The first slide element may be arranged as a protrusion of the coupling link.

In a further embodiment of the adjustment mechanism, the second sliding joint involves a guide ramp arranged at a cutting head housing, wherein a second slide element of the coupling link is provided which is movably received at the guide ramp. Also the second sliding joint may be arranged as a protrusion or projection at the coupling link.

In one embodiment, the coupling link is an integrally formed portion of the adjustable comb. Consequently, the coupling link may be defined by or formed at a lateral wall portion of the adjustable comb. The adjustable comb may be arranged as an integrally formed injection-moulded part. Preferably, in one embodiment, two mirror-symmetric coupling links including respective first and second slide elements are provided at two opposite lateral walls of the adjustable comb. At least one of the first slide element and the second slide element may be defined as an inwardly projecting protrusion. Consequently, when two respective elements are provided, a snap-on or click-on contour may be defined which is arranged to engage mating elements of the sliding joints.

Therefore, by attaching the adjustable comb to the housing of the cutting head, the adjustable comb may also engage the first sliding joint and/or the second sliding joint. Consequently, assembly work and operation the appliance may be significantly simplified.

In a further refinement of the adjustment mechanism, the first slide element is received in such a way at the first sliding joint that the second slide element, at least in one of the first position and the second position, contacts the guide ramp in a preloaded fashion. This may involve, at least in some embodiments, that the adjustable comb is attached to the cutting head housing in a preloaded fashion.

In this way, a tight fit arrangement of the adjustable comb may be achieved. Therefore, the adjustable comb is received in a preloaded fashion and therefore not susceptible to rattling and/or a loose fit. This may further improve the hair cutting or hair trimming performance of the appliance.

In yet another refinement of the adjustment mechanism, the first slide element is movably received at the first sliding joint, wherein an angular displacement of the adjustable comb induces a load on the first slide element which urges the second slide element into close contact with the guide ramp.

By way of example, the length adjustment mechanism may be defined in such a way that, at least in one of the first position and the second position, an over-determined state in present. This may be for instance achieved when the first slide element is arranged in a bar-like fashion. Consequently, a bar-shaped slide element is received in the slot or groove at the cutting head housing in a longitudinally movable fashion. However, as the path defined by the second sliding joint somewhat deviates from the path defined by the first sliding joint, a bending force or flexing force is generated when the adjustable comb including the coupling link is moved between the first and the second position. This may be used so as to generate an integrated tension which forces the adjustable comb into a tight fit with the housing of the cutting head.

A further advantage of this arrangement is that no additional compensation elements (springs, rubber components) are required to define a substantially free-of-play fit of the adjustable comb at the cutting head. Hence, even though the comb is movable with respect to the housing of the cutting head, a defined snug fit may be achieved.

Generally, the coupling link including the first slide element and the second slide element may be arranged in an at least partially deflectable fashion so as to adapt the coupling link to the paths of the first sliding joint and the second sliding joint, and to induce the desired flex of the adjustable comb.

In yet another refinement, the adjustment mechanism further comprises a driving linkage arranged to operate the driving slider, and an operating lever for an actuating movement, wherein the operating lever is preferably arranged as a swivel lever.

The operating lever may be referred to as a contour or element which is accessible for the user of the hair cutting appliance so as to define a desired length setting. Via the operating lever, the adjustment mechanism, particularly the driving slider thereof, may be actuated so as to displace the adjustable comb in the desired fashion.

In a refinement of the above embodiment, a plurality of index positions are formed at the cutting head housing, wherein the operating lever is arranged to selectively engage the index positions so as to define and effect a respective length setting of the adjustable comb. Consequently, the operating lever may be brought into engagement with one of the index positions which correspond to a respective length setting of the adjustable comb. In this way, a number of graduated length offsets between the adjustable comb and the blade set of the appliance may be defined.

The operating lever may be actuated and/or activated so as to be brought into engagement with a respective index position. Consequently, the operating lever may be arranged to be activated in an activation direction and moved in an adjustment direction. For instance, the adjustment direction is associated with a swivel movement of the operating lever, wherein the actuation or activation direction is associated with a push/pull movement of the operating lever. By way of example, the index position may be defined by respective teeth or similar protrusions/recesses at the housing of the cutting head. By defining an offset or pitch between respective ones of the index elements, the length offset setting may be effected.

In still another refinement of the adjustment mechanism, a transmission rocker element is provided which is arranged between the operating lever and the driving slider, wherein the transmission rocker element is pivotably arranged at the cutting head housing, wherein a transmission joint is formed between the transmission rocker element and the driving slider, and wherein the driving slider is longitudinally moved when the transmission rocker element is pivoted. Consequently, a pivoting input movement can be transformed into a longitudinal sliding movement of the driving slider which, again, is transformed into a combined longitudinal/swiveling movement of the adjustable comb.

In another refinement of the above embodiment of the adjustment mechanism, the operating lever is coupled with the transmission rocker element for operating the driving linkage, wherein a biasing element is provided between the operating lever and the transmission rocker element, and wherein the biasing element urges the operating lever against the cutting head housing into a rest position. The rest position may be defined by one of the index elements. Consequently, the rest position may correspond to any state where the operating lever is positioned at one of the index positions.

Consequently, for activating the adjustment mechanism, the operating lever may be moved with respect to the transmission rocker element in an activation direction. For adjusting the adjustable comb, in an activated/released state of the operating lever, the operating lever may be moved with the transmission rocker element in a common swiveling movement.

In still another refinement of the adjustment mechanism, the transmission rocker element is provided with an indexing toothing, wherein a deflectable engagement element is provided, and wherein the deflectable engagement element cooperates with the indexing toothing, thereby defining an indexing rest position of the transmission rocker element. In an alternative embodiment, the indexing toothing is provided at the housing of the cutting head, whereas the deflectable engagement element is arranged at the rocker element. Generally, one of the rocker element and the housing of the cutting head may be provided with the indexing toothing, and the other one may be provided with the deflectable engagement element.

Consequently, indexing elements may be provided between the operating lever and the housing of the cutting head. Similarly, additional indexing elements may be provided between the transmission rocker element and the deflectable engagement element which is, as such, also attached to the housing of the cutting head. Preferably, the respective pitch of the sets of indexing elements is adapted to one another. Provided that respective indexing teeth are provided, an (angular) pitch may be basically the same.

Preferably, the deflectable element is arranged at the housing of the cutting head. For instance, the deflectable engagement element is arranged as a flat spring. Different shapes involving an integrally shaped deflectable engagement element which forms part of the housing of the cutting head may be envisaged. Assuming that the operating lever is actuated and therefore brought out of engagement with one of the index positions at the housing of the cutting head, the indexing toothing and the corresponding deflectable engagement elements allow for an indexing operation including a respective sound feedback (e.g. clicking noises) to the user. Consequently, a defined stepwise adjustment of the adjustable comb is enabled which further facilitates the length setting procedure.

Generally, the operating lever may be movably coupled with the transmission rocker. Both, the operating lever and the transmission rocker may swivel or pivot about a common pivoting axis when the operating lever is activated accordingly. Therefore, the operating lever is also arranged as a rest feature for the adjustment mechanism.

In another aspect of the present disclosure, a cutting head assembly for a hair cutting appliance is presented, the cutting head assembly comprising a blade set including a movable blade and a stationary blade which are arranged to be moved with respect to one another to cut hair trapped therebetween, wherein the cutting head assembly comprises an adjustment mechanism in accordance with at least one embodiment as discussed herein. The cutting head assembly may also involve the adjustable comb, or a selected comb from a set of adjustable combs, the comb being arranged to be attached to the cutting head, preferably in a releasable fashion.

Further, in accordance with another aspect of the present disclosure, a set comprising a respective cutting head assembly and at least one adjustable spacing comb is provided. In some embodiments, the set comprises a plurality of adjustable combs which may involve a different shape. The at least one adjustable spacing comb in accordance with this embodiment is preferably arranged as a releasably attachable comb arranged for being attached to and detached from the cutting head housing in a click-on or snap-on fashion.

In still another embodiment of the present disclosure, a hair cutting appliance, particularly an electrically powered hair trimmer, is presented, the appliance being arranged to be moved through hair to cut hair, the appliance comprising a housing, a cutting head, an adjustable comb, and an adjustment mechanism in accordance with at least one embodiment as discussed herein. The adjustable comb may form an integrated (non-releasable) component of the hair cutting appliance. However, at least in some embodiments, the adjustable comb may be detached from and attached to the housing of the hair cutting appliance, depending on a present operation mode (for instance, shaving mode and trimming mode).

BRIEF DESCRIPTION OF THE DRAWINGS

These and other aspects of the disclosure will be apparent from and elucidated with reference to the embodiments described hereinafter. In the following drawings

DETAILED DESCRIPTION OF THE EMBODIMENTS

Figure 1:
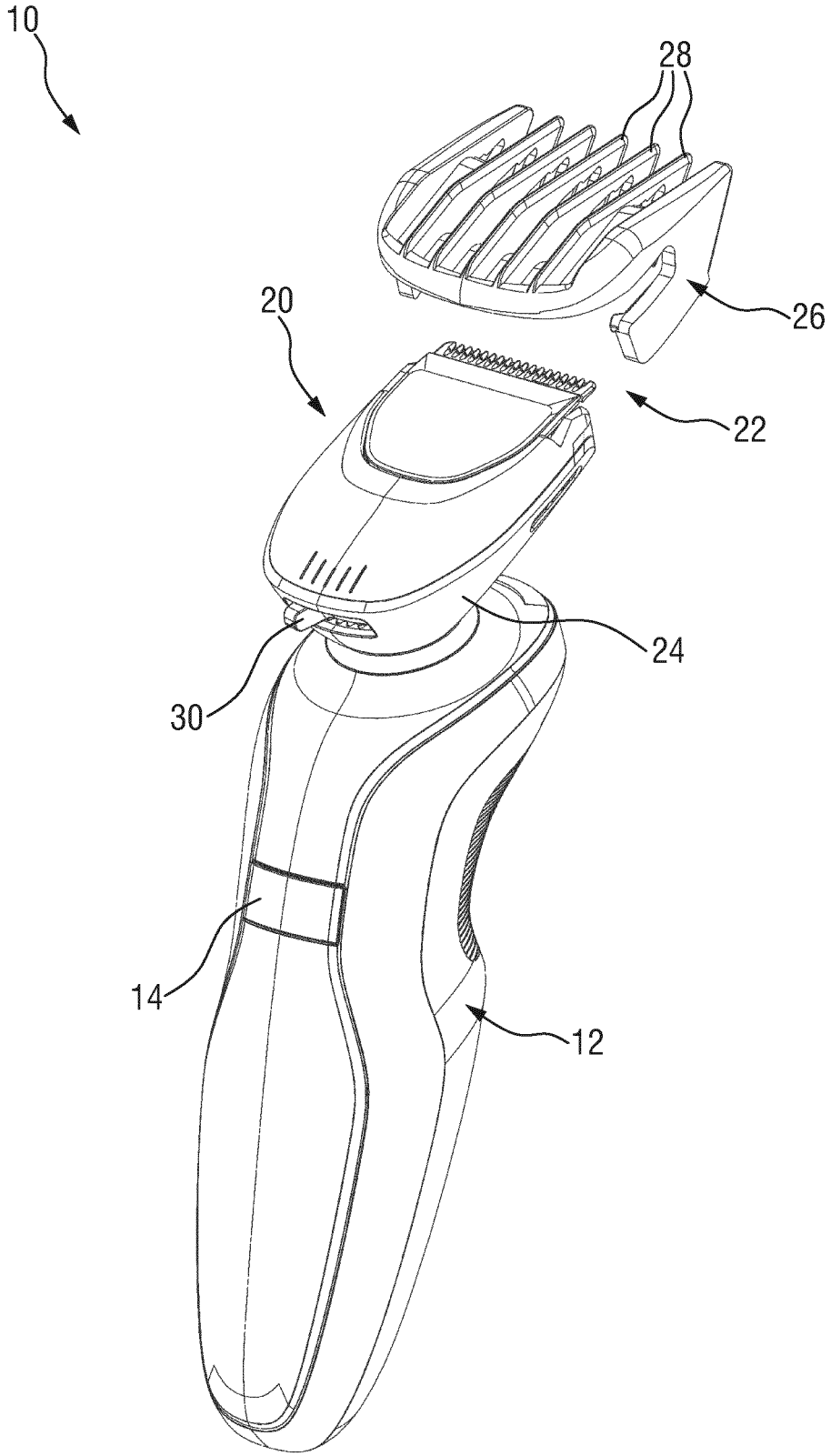
FIG. 1 shows a perspective rear view of a hair cutting appliance including an adjustable comb, the comb showing in a detached/separated state.

FIG. 1 shows a hair cutting appliance 10. Conventional hair cutting appliances as such are widely known and described in the art.

The hair cutting appliance 10 comprises a housing 12 and operating controls 14, for instance an on/off bottom. The housing 12 may accommodate a motor, a battery (if any), a power supply (if any), a control unit, and a drive train or drive mechanism. Generally, the housing 12 of the hair cutting appliance 10 has an elongated shape having a first end and a second end. The first end may be also referred to as cutting head end. At the first end of the housing 12, a cutting head 20 is provided. At the cutting head 20, a blade set 22 is arranged. As shown in the exemplary embodiment of FIG. 1, the cutting head 20 is arranged in a somewhat exposed and elevated fashion. Consequently, a cutting head housing 24 is provided which may be referred to as a portion of the overall housing 12.

In accordance with the exemplary embodiment of FIG. 1, the cutting head 20 is arranged in a pod-like fashion. The pod-like shape of the cutting head 20 has the advantage that the cutting head 20 is elevated with respect to the housing 12 of the appliance 10. This may facilitate shaving or trimming hair at hard-to-reach areas. However, this requires that internal components of the appliance 10 are arranged to accommodate and/or enable the relative rotation between the (main) housing 12 and the cutting head 20. This may also pose challenges to comb adjustment arrangements.

The arrangement of the hair cutting appliance 10 of FIG. 1 has the advantage that the cutting head 20 may be separated from a main portion of the appliance 10. For instance, in exemplary embodiments, difference cutting heads 20 may be provided, such as a (foil) shaving head, a trimming head, a styling head, etc. The cutting head 20 as exemplarily shown in FIG. 1 is particularly suited for trimming operations.

Figure 2:
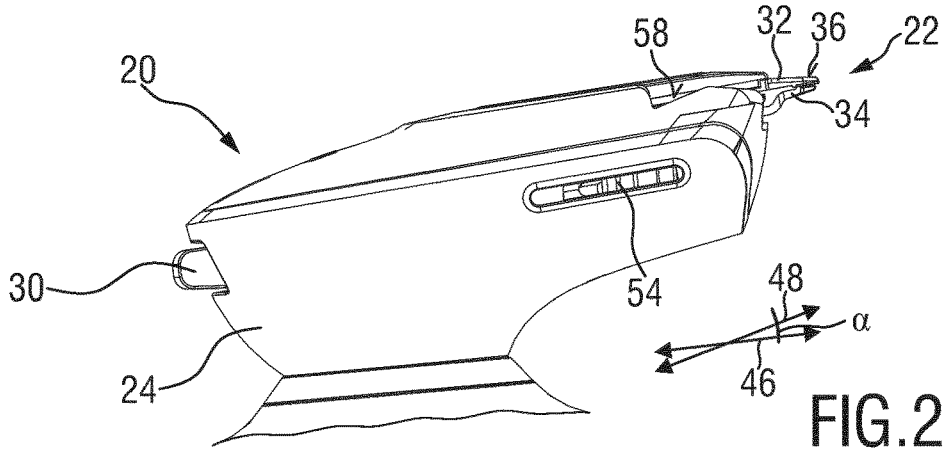
FIG. 2 shows a lateral view of a cutting head portion of the appliance as shown in FIG. 1, wherein the adjustable comb is omitted in FIG. 2 for illustrative purposes.

However, in alternative embodiments, the cutting head 20 may form a more integrated component of the appliance 10, wherein particularly the housing 24 of the cutting head 20 is arranged as an integral portion of the (overall) housing 12. Therefore, as used herein, the housing 24 of the cutting head 20 shall not be regarded as a necessarily distinct housing. Rather, the housing 24 of the cutting head 20 may be arranged as a distinct, elevated housing (as shown in FIG. 2) or as an integrated housing portion of the overall housing portion 12.

Consequently, whenever reference is made herein to the cutting head housing 24, this may refer as well to the overall housing 12 of the appliance 10, where applicable.

As shown in FIG. 1 in a detached state, a comb 26 may be provided to be attached to the appliance 10, particularly to the cutting head 20 thereof. In some embodiments, a plurality of combs 26 having different shapes and/or characteristics may be provided. The comb 26 is arranged as a movable comb which is movable with respect to the housing 12 of the hair cutting appliance 10. Generally, as will be discussed in more detail hereinafter, the appliance 10, particularly the cutting head 20 thereof, is provided with a length setting feature so as to operate and move the adjustable comb 26 accordingly. Therefore, also a single comb 26 may enable a defined set of length setting values.

As indicated by reference numeral 28, a number of comb teeth may be provided. The teeth 28 of the comb 26 define a contact plane or resulting contact edge of the appliance 10 when the comb 26 is mounted thereto.

At the cutting head 20, an operating lever 30 is provided. The operating lever 30, at least a portion thereof, extends through a corresponding opening slot in the housing 24 of the cutting head 20. The operating lever 30 may be actuated so as to move the adjustable comb 26 in a defined fashion for length adjustment.

Figure 3:
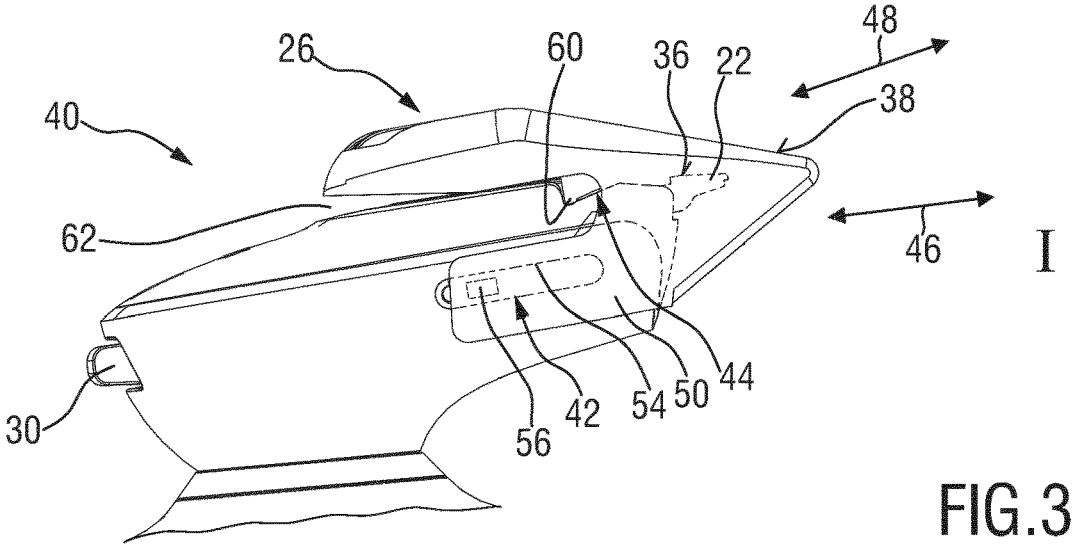
FIG. 3 shows another lateral view of the cutting head portion, wherein an adjustable comb is attached to the cutting head, the comb shown in a first, retracted position.
Figure 4:
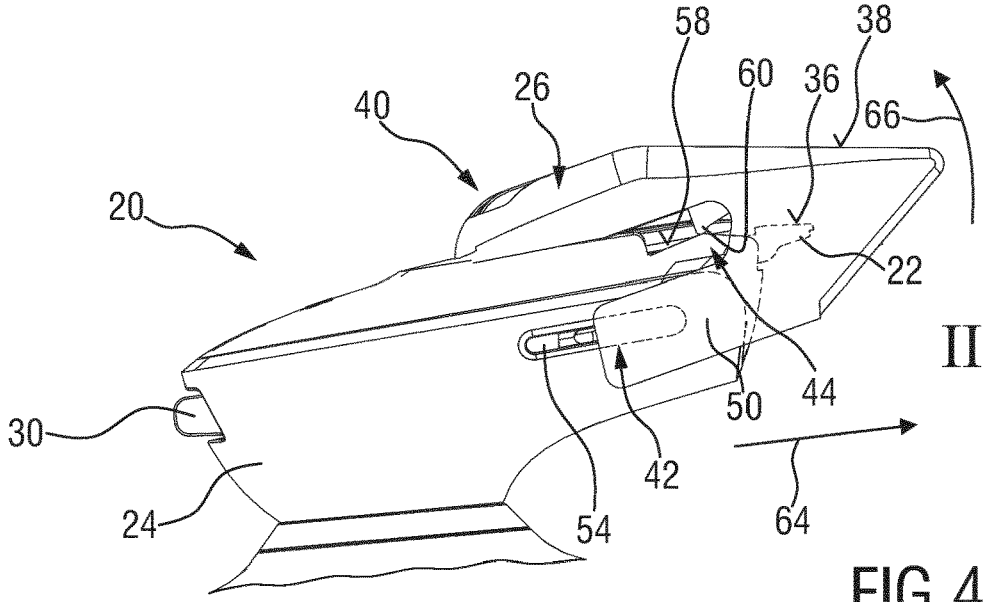
FIG. 4 shows another view of the arrangement of FIG. 3, the comb shown in a second, extracted position.

Further reference is made to FIGS. 2, 3, and 4 showing respective partial lateral views of the cutting head 20 of the appliance 10. In FIG. 2, the cutting head 20 is shown in a shaving mode, where no adjustable comb 26 is present. In FIG. 3 and FIG. 4, the comb 26 is attached to the housing 24 of the cutting head 20. Further, the comb 26 is shown in FIG. 3 in a first state I, and in FIG. 4 in a second state II.

In the shaving mode or shaving configuration of FIG. 2, the blade set 22 is not obstructed or spaced away by the comb 26. Consequently, the blade set 22 can be brought into close contact with the skin so as to cut hair very close to the skin.

Generally, the blade set 22 comprises a stationary blade 32 including a number of stationary teeth. Further, a movable blade 34 including a number of movable teeth is provided. The stationary blade 32 may be also referred to as guard. The movable blade 34 may be also referred to as cutter.

In the shaving mode as shown in FIG. 2, a top face or top end 36 of the blade set 22 may basically contact the skin of the to-be-treated person (or animal).

By contrast, in the trimming configuration as shown in FIGS. 3 and 4, the comb 26 is attached to the cutting head 20. Consequently, a top face or top end 38 defined by the teeth 28 of the comb 26 may contact the skin and therefore space the top end 36 of the blade set 22 away from the skin. Therefore, the comb 26 defines an offset between the blade set 22 and the skin which basically corresponds to a remaining length of the processed hair.

As used herein, the top side of the comb 26 shall be referred to as the side of the comb 26 which contacts the skin when the appliance 10 is in operation. Consequently, the bottom side of the comb 26 designates the side thereof that is facing away from the skin when the appliance 10 is in operation.

As indicated by the states I and II in FIG. 3 and FIG. 4, the comb 26 is arranged as an adjustable comb and movably received at the cutting head 20. For operating and adjusting the comb 26, an adjustment mechanism 40 is provided which will be further detailed and discussed hereinafter. In FIG. 3 and FIG. 4, the blade set 22 is covered by the comb 26 and therefore indicated by dashed lines.

The adjustment mechanism 40 comprises a first sliding joint 42 and a second sliding joint 44. Each of the first sliding joint 42 and the second sliding joint 44 is defined between the comb 26, particularly a coupling link 50 thereof, and the cutting head 20, particularly the housing 24 thereof.

As indicated in FIGS. 2 and 3, the first sliding joint 42 defines a first movement direction 46. Further, the second sliding joint 44 defines a second movement direction 48. The movement directions 46, 48 of the sliding joints 42, 44 are arranged in a non-parallel fashion at an angular offset (offset angle alpha).

The coupling link is indicated by reference numeral 50 in FIGS. 3 and 4. In an exemplary embodiment, the coupling link 50 is arranged as an integral portion of the comb 26. Preferably, the coupling link 50 is arranged at and/or defined by a lateral arm of the comb 26 (refer also to FIG. 5 in this connection).

Via the coupling link 50, the comb 26 engages both the first sliding joint 42 and the second sliding joint 44. Consequently, the coupling link 50 is simultaneously moved in the first movement direction 46 and in the second movement direction 48 which involves a position change and an orientation change of the coupling link 50. The combined movement is illustrated in FIG. 3 and in FIG. 4, wherein the comb 26 including the coupling link 50 is shown in FIG. 3 in a first, refracted position I and in FIG. 4 in a second, extracted position II. The comb 26 is moved between the positions I and II in a longitudinal fashion (arrow 64 in FIG. 4), but also in a pivoting fashion (arrow 66 in FIG. 4). Consequently, a combined movement of the comb 26 may be achieved which involves a progressive transmission ratio between the states I and II. The combined movement between the first position I and the second position II involves a longitudinal component 64 and a pivoting component 66.

Again, reference is made to FIG. 2. At the cutting head, particularly at the housing 24 thereof, a guide slot 54 (also referred to as guide groove or guide recess) is provided. The guide slot 54 forms part of the first sliding joint 52. Further, a guide ramp 58 is provided at the housing 24 of the cutting head 20 which may be also referred to as guide cam. The guide ramp 58 forms part of the second sliding joint 44.

As can be best seen in FIG. 2, the guide slot 54 extends in the first direction 46. Further, the guide ramp 58 extends in the second direction 48. The first direction 46 and the second direction 48 are inclined with respect to another by an offset angle $\alpha$ (alpha).

Figure 5:
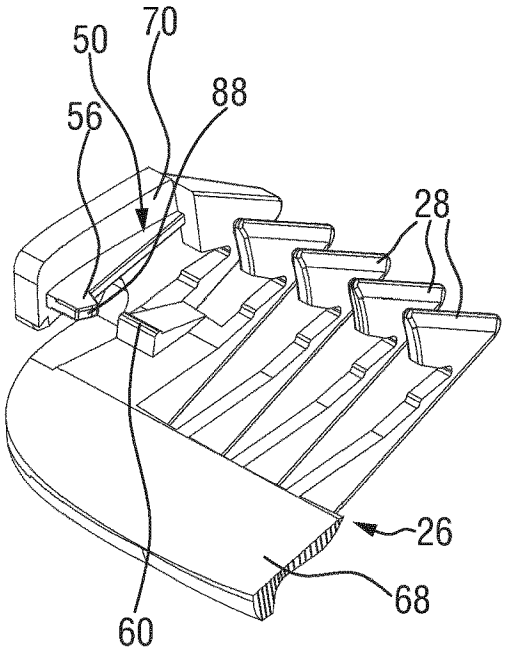
FIG. 5 shows a perspective partial cross-sectional bottom view of an adjustable comb.

At the comb 26, mating elements for the guide slot 54 and the guide ramp 58 are provided. Reference is made in this context to FIG. 3, FIG. 4, and to FIG. 5. FIG. 5 shows a partial perspective cross-sectional view of the comb 26. Preferably, at least in one embodiment, the comb 26 is arranged in a basically mirror-symmetric fashion. Consequently, also the housing 24 of the cutting head 20 may be arranged in a basically mirror-symmetric fashion. More generally, at each respective lateral side of the comb 26 and the housing 24, a first sliding joint 42 and a second sliding joint 44 may be provided.

At the comb 26, a first slide element 56 is provided which is arranged to contact or engage the guide slot 54. The guide slot 54 and the first slide element 56 define the first sliding joint 42.

Further, at the comb 26, a second slide element 60 is provided which is arranged to contact or engage the guide ramp 58. Consequently, the guide ramp 58 and the second slide element 60 define the second sliding joint 44.

As can be best seen in FIG. 5, the first slide element 56 is arranged as an inwardly protruding projection extending from a lateral end of the comb 26. Similarly, also the second slide element 60 may be arranged as a projection. The second slide element 60 extends from a top wall portion of the comb 26 towards the bottom thereof.

In FIG. 5, a top wall or bar of the comb 26 is designated by reference numeral 68. Further, a side wall or side arm is designated by reference numeral 70. The coupling link 50 is an integrated portion of the comb 26 extending between and coupling the first slide element 56 and the second slide element 60, at least in accordance with the embodiment of FIG. 5.

When mounting the comb 26, the side wall or side arm 70 may be outwardly deflected in such a way that the first slide element 56 may engage the guide slot 54. Consequently, the comb 26 may be mounted to the cutting head 20 in a snap-on fashion. No additional fasteners or similar attachment components are required. In the mounted state, the side walls 70 of the comb 26 embrace the housing 24 of the cutting head 20.

As can be best seen in FIG. 3 and in FIG. 4, when the comb 26 is moved between the first position I and the second position II, the first slide element 56 is moved along a first path corresponding to the first movement direction 46, and the second slide element 60 is moved along a second path corresponding to the second movement direction 48.

The movement paths defined by the first sliding joint 42 and the second sliding joint 44 do not necessarily have to be arranged as linear paths. Rather, also curved paths may be defined by the first sliding joint 42 and the second sliding joint 44. Generally, the first movement direction 46 and the second movement direction 48 are arranged in a non-parallel fashion which may involve an angular offset therebetween.

More generally, the first sliding joint 42 and the second sliding joint 44 may define a first movement path and a second movement path which are differently shaped in such a way that the coupling link 50 which engages both, the first sliding joint 42 and the second sliding joint 44 is moved not only in a linear fashion but also in a swiveling fashion. For instance, the first sliding joint 42 and the second sliding joint 55 may deviated from one another, of may be formed in a diverging fashion.

An advantage of the above embodiments is that different movement transmission ratios may be present at or between the first position I and the second position II. This may involve that a fine-graduated length adjustment (small step size) is enabled in the proximity of the first position I as shown in FIG. 3 (small increments). Rather, relatively large increments (step size) may be present in the proximity of the second state as shown in FIG. 4.

Consequently, a defined relative input movement causes, in the first state I, a first response (increment), while basically the same relative input movement causes, in the second state II, a different, second response (increment) which is larger than the first response. This may have the advantage that small increments are present in a short hair range (e.g., 1.00 mm, 1.5 mm, 3.0 mm, etc.), whereas large increments are present in the long-hair range (e.g., 9.0 mm, 12.0 mm, 16.0 mm, etc.).

Further, between the first state and the second state, the angular orientation of the top end 38 of the comb 26 with respect to the top end 36 of the blade set 22 may be changed which may induce a more appropriate overall orientation of the appliance 10 with respect to the skin.

In FIG. 3, a rear clearance 62 between the comb 26 and the housing 24 of the cutting head 20 is illustrated. Since the comb 26 is not only linearly moved but also pivoted, the clearance 62 is provided so as to ensure that sufficient room for the pivoting movement is provided (refer also to FIG. 4, particularly to the arrow 66 therein). Consequently, the adjustment mechanism 40 ensures that in each state of (length adjustment) operation, an appropriate transmission ratio between the input actuating movement and the resulting output movement of the comb 26 is present.

Figure 7:
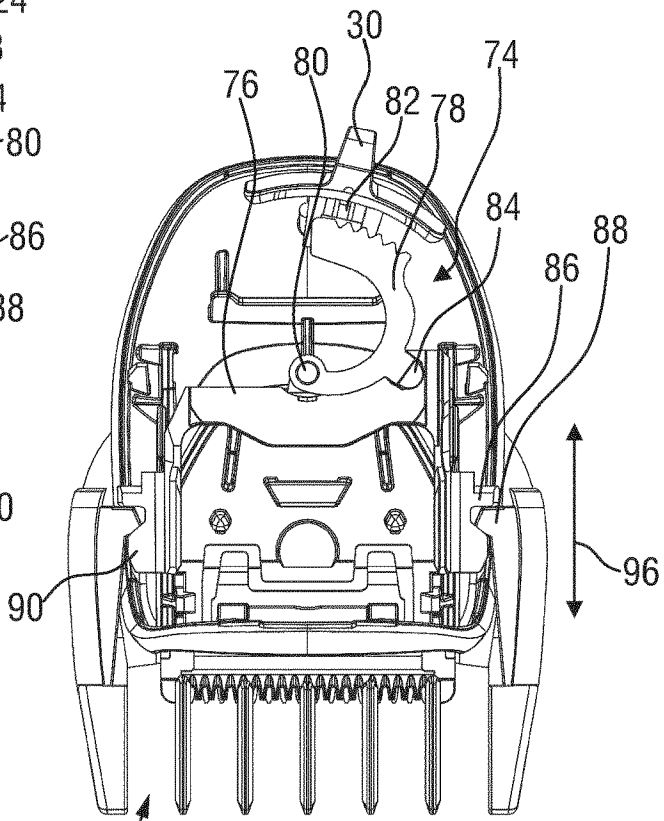
FIG. 7 shows another view of the arrangement of FIG. 6, the comb shown in a second position.
Figure 6:
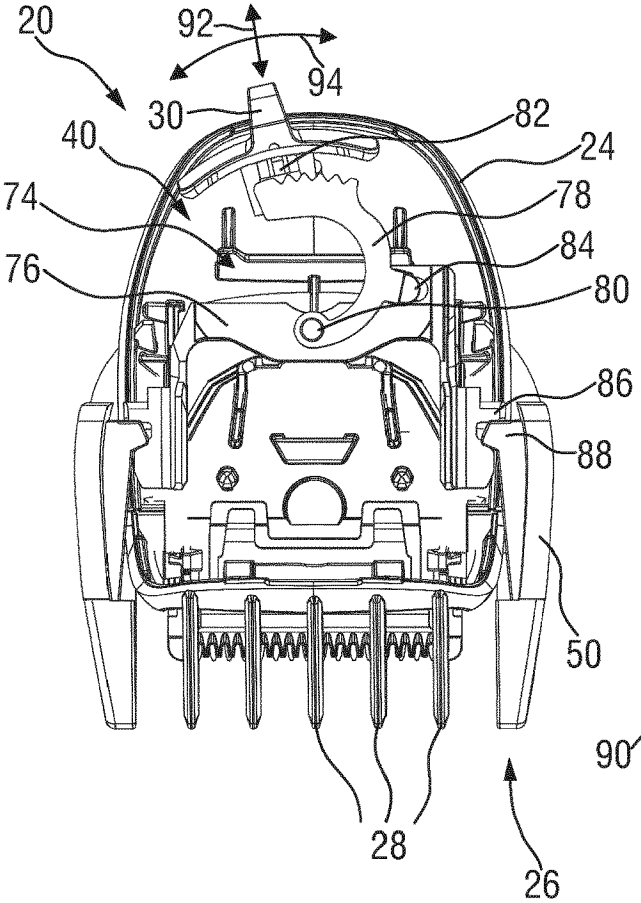
FIG. 6 shows a bottom view of a cutting head to which an adjustable comb is attached, wherein a housing portion is omitted, the comb shown in a first position.

Further reference is made to FIG. 6 and to FIG. 7 illustrating a bottom view of the cutting head 20 to which the comb 26 is attached. FIG. 6 illustrates a first, retracted state I, as with FIG. 3. FIG. 7 illustrates a second, extracted state II, as with FIG. 4. In FIG. 6 and FIG. 7, a portion of the housing 24 of the cutting head 20 is omitted for illustrative purposes. Further, several interior components of the cutting head 20 are omitted for illustrative purposes.

The length adjustment mechanism 40 further includes a driving linkage 74 for operating the adjustable comb 26. For enlarged views of components of the driving linkage, additional reference is made to FIG. 8 and to FIG. 9.

The driving linkage 74 includes a driving slider 76 which is movably or slidably received at the housing 24. Further, the driving linkage 74 comprises a transmission rocker 78 which may be also referred to as transmission link.

The transmission rocker 78 is pivotably received at the housing 24. In FIG. 6 and FIG. 7, reference numeral 80 indicates a pivot point of the transmission rocker 78. The transmission rocker 78 is arranged between the operating lever 30 and the driving slider 76. The transmission rocker 78 transmits an operating movement from the operating lever 30 to the driving slider 76 and, consequently, to the comb 26, as will be discussed in more detail hereinafter.

Between the operating lever 30 and the transmission rocker 78, a link 82 is defined which may be also referred to as actuation link or activation link. Further, between the transmission rocker 78 and the driving slider 76, a link 84 is provided to transfer the driving movement.

Figure 8:
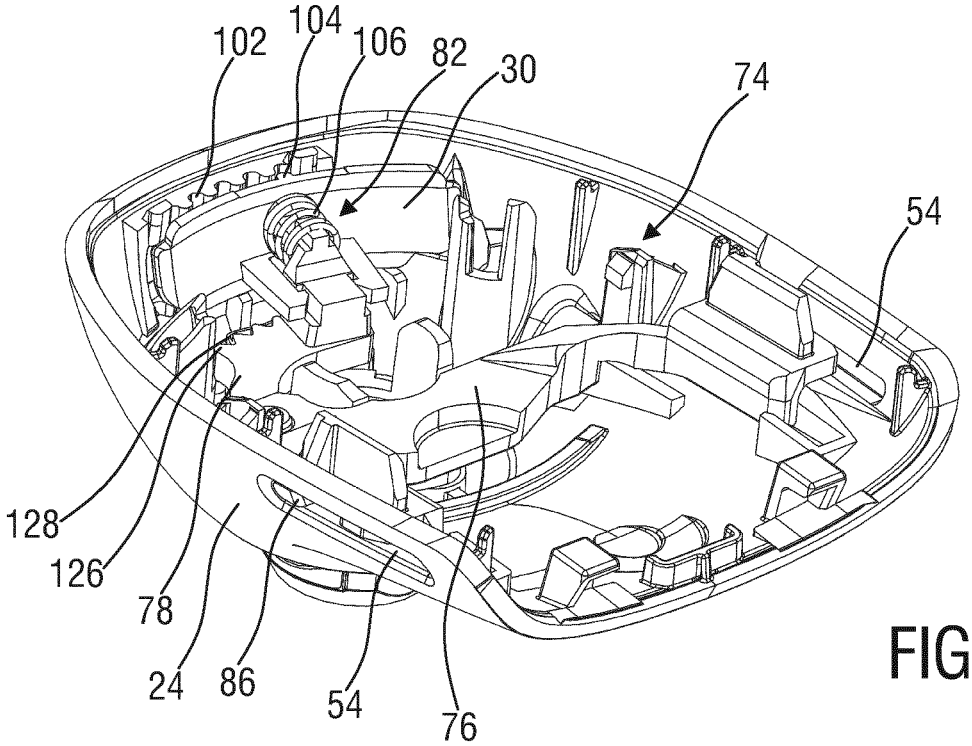
FIG. 8 is a perspective partially top view illustrating an interior of an exemplary arrangement of a cutting head.
Figure 9:
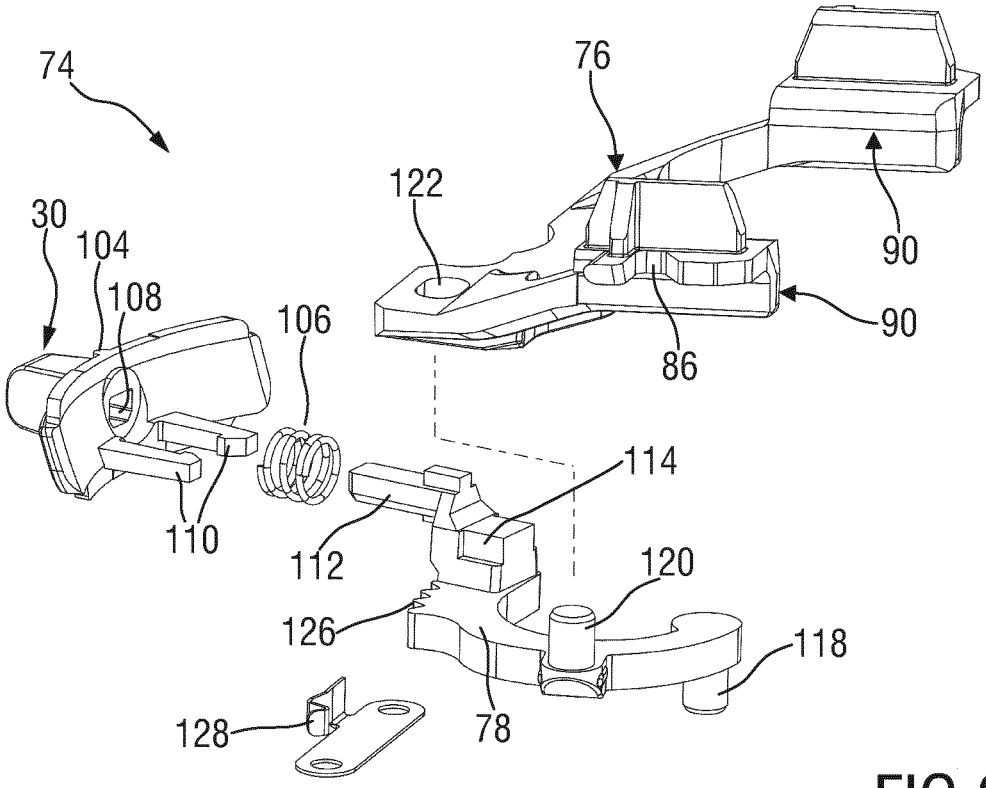
FIG. 9 is a perspective exploded view of internal components of the cutting head shown in FIG. 8, wherein the orientation of the view of FIG. 9 is different form the orientation of FIG. 8.

As can be best seen in FIG. 8 and in FIG. 9, the driving slider 76 of the exemplary embodiment discussed herein is arranged in a basically U-shaped or V-shaped fashion comprising two arms 90. Generally, the driving slider 76 is arranged to drive or entrain the comb 26. To this end, a driving contour 86 (e.g. a lateral recess) is provided which is arranged to cooperate with a corresponding engagement contour 88 (ref. to FIGS. 5 to 8) of the comb 26. The driving contour 86 is arranged at the arm 90.

At the comb 26, the engagement contour 88 may be integrally shaped with, or formed as a part of the first slide element 56. In accordance with this embodiment, the first slide element 56 of the comb 26 and the driving contour 86 of the driving slider 76 engage one another in the vicinity of the guide slot 54. However, in alternative embodiments, the engagement contour 88 and the first slide element 56 may be separated from one another.

So as to initiate an adjustment operation, the operating lever 30 may be activated in an activation direction 92, refer to FIG. 6. Once the operating lever 30 is activated, a swiveling motion (refer to the curved double arrow 94 in FIG. 6) may be induced. Via the link 82, the operating lever 30 is coupled with the transmission rocker 78. Consequently, the operating lever 30 and the transmission rocker 78 may be pivoted about the pivot point 80. This pivoting movement is transmitted to the driving slider 76 via the link 84. Consequently, a translation movement of the driving slider 76 is induced (refer to the double-arrow 96 in FIG. 7).

The translation movement 96 of the driving slider 76 is transmitted to the comb 26, via the driving contour 86 and the engagement contour 88. As a result, also the comb 26 is moved. However, as already discussed hereinbefore, the comb 26 is displaced in a combined longitudinal end pivoting movement (refer to the arrows 64, 66 in FIG. 4). Hence, a longitudinal driving movement is converted into a combined output movement.

With reference to FIG. 8 and to FIG. 9, an exemplary embodiment of the driving linkage 74 of the adjustment mechanism 40 will be discussed in more detail. Additional reference is made to the partial enlarged view of FIG. 10.

Figure 10:
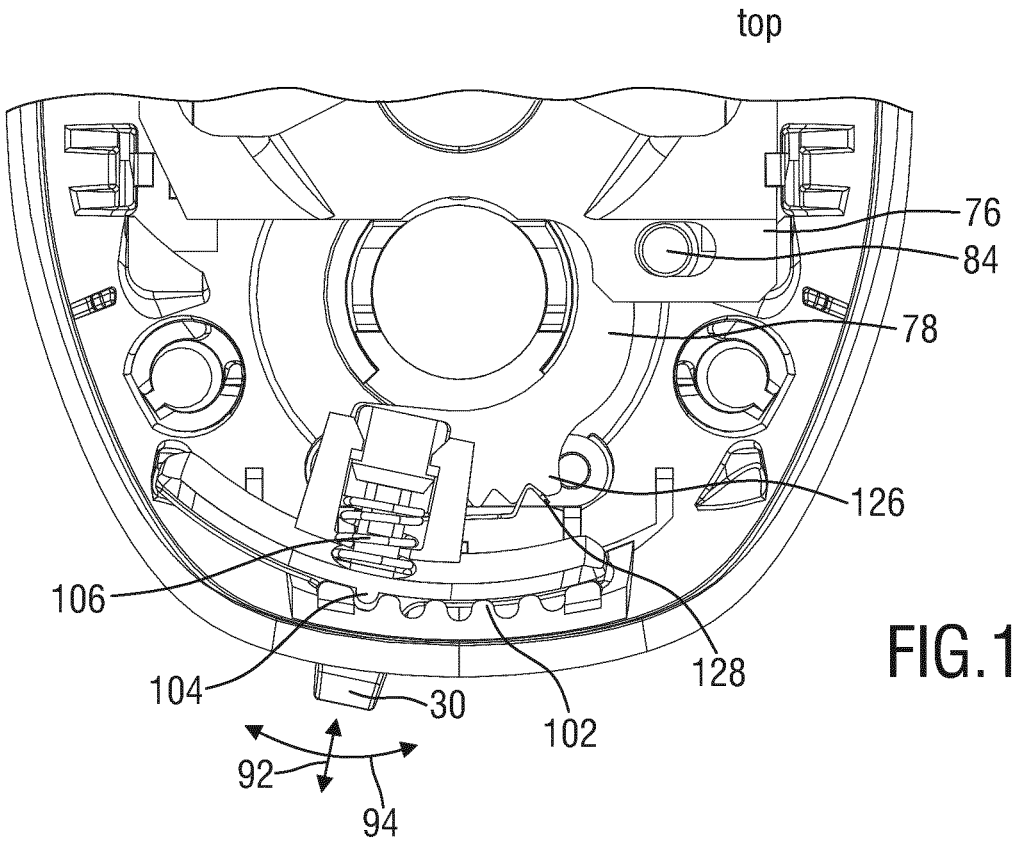
FIG. 10 is a partial detailed top view of the arrangement of FIGS. 8 and 9.

As can be best seen in FIG. 8 and in FIG. 10, a number of index positions 102 formed by respective teeth (more generally, a series of elevations and indents) may be provided at the housing 24 of the cutting head 20. At the operating lever 30, a corresponding engagement protrusion (engagement tooth) 104 may be provided which is arranged to selectively engage a respective index position 102.

Further, a biasing element 106 is arranged between the operating lever 30 and the transmission rocker 78. In the exemplary embodiment of FIGS. 8 to 10, the biasing element 106 is arranged as a helical spring. The biasing element 106 urges the engagement protrusion 104 of the operating lever 30 into engagement with one of the index positions 102. Therefore, for activating the operating lever 30, and, as a consequence, the driving linkage 74, a user has to push the operating lever 30 in the activation direction 92 so as to compress the biasing element 106 and to disengage the engagement protrusion 104.

With reference to the exploded view of FIG. 9, the joint between the operating lever 30 and the transmission rocker 78 is described in more detail. At the operating lever 30, a guide recess 108 is formed which is arranged to receive a mating protrusion 112 of the transmission rocker 78. Adjacent to the guide recess 108, engagement arms 110 are provided which are arranged to engage a resting contour or snap-on contour 114 which is arranged at the transmission rocker 78 adjacent to the mating protrusion 112. Consequently, the operating lever 30 may be secured on the transmission rocker 78 in a snap-on fashion whereas the biasing element 106 is provided therebetween and received at the mating protrusion 112 which at least partially engages the guide recess 108. A defined translation movement between the operating lever 30 and the transmission rocker 78 is enabled so as to selectively lock or unlock the engagement protrusion 104 with respect to one of the index positions 102 (refer to FIG. 8).

As can be further seen from FIG. 9, a bearing pin 118 is provided at the transmission rocker 78 which is arranged to be received at the housing 24, thereby defining the pivot point 80. Further, a pin 120 is provided at the transmission rocker 78 which is arranged to engage a corresponding slot or groove 122 at the driving slider 76, thereby defining the pin and groove link 84, refer also to FIG. 6 and to FIG. 7.

So as to further facilitate the operation and to enable a stepwise adjustment, in an exemplary embodiment, a further indexing arrangement is provided for the transmission rocker 78. At the transmission rocker 78, an indexing toothing 126 is provided which is arranged to cooperate with an engagement element 128, refer also to FIG. 10.

As can be best seen in FIG. 9, the engagement element 128 is at least sectionally deflectable and may be for instance formed as a leaf spring. The deflectable portion of the engagement element 128 is arranged to engage grooves between the teeth of the indexing thoothing 126. Since the engagement element 128 is at least partially deflectable, and therefore does not lock the transmission rocker 78, the engagement element 128 enables a defined stepwise rotation thereof. Preferably, the engagement element 128 also generates a distinct clicking noise so as to provide feedback to the user.

FIG. 10 shows a partial top view of the arrangement of FIG. 8 and further illustrates the indexing arrangements for the operating lever 30 and the transmission rocker 78.

Figure 11:
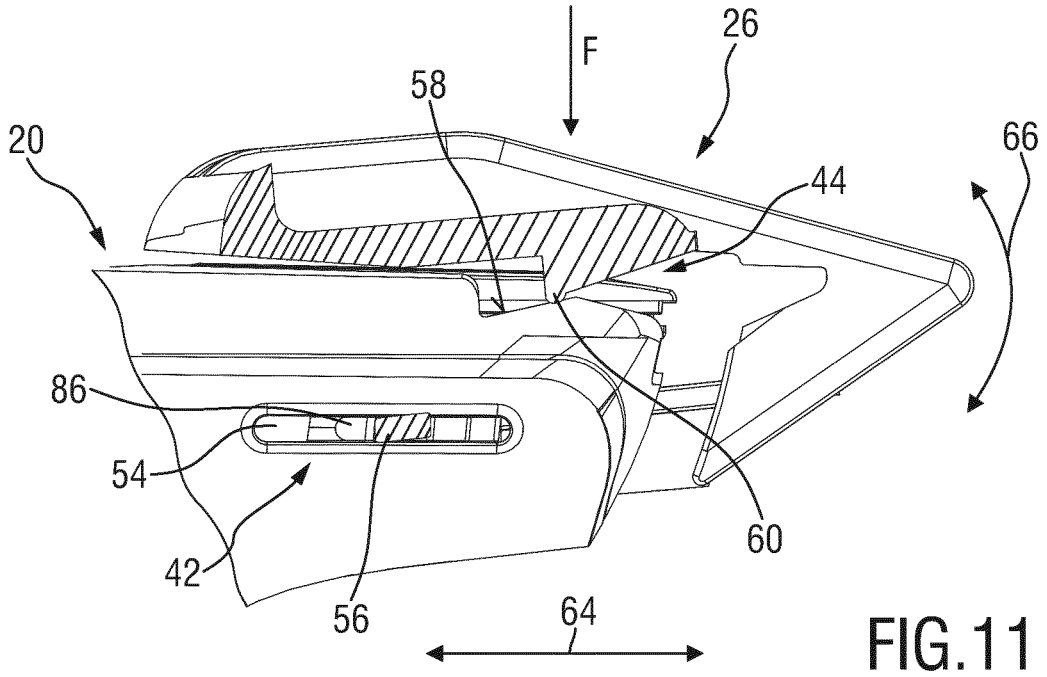
FIG. 11 is a partial cross-sectional lateral view of a cutting head for a hair cutting appliance to which an adjustable comb is attached.

Further reference is made to FIG. 11 illustrating a simplified partial cross-sectional lateral view of a cutting head 20 to which an adjustment comb 26 is attached. For illustrative purposes, a cross-sectional view of an engagement section of the adjustable comb 26 is shown.

As with the embodiments discussed hereinbefore, a first sliding joint 42 and a second sliding joint 44 is provided at the length adjustment mechanism 40. At the first sliding joint 42, a guide slot 54 is formed which is engaged by a first slide element 56. Further, a driving contour 86 (of the driving slider 76) is indicated in FIG. 11. Both, the driving contour 86 and the first slide element 56 are movably received at or at least arranged adjacent to the guide slot 54.

Further, the second sliding joint 44 is defined by a guide ramp 58 and a corresponding second slide element 60. The second slide element 60 involves a rounded protruding contour at the comb 26 which is arranged to slide along the path defined by the guide ramp 58.

As the movement paths defined by the first sliding joint 42 and the second sliding joint 44 are different from one another, preferably arranged at an angular offset, the comb 26 is not only longitudinally moved (arrow 64) but also pivoted or swiveled (arrow 66) when being moved between the first state I and the second state II (refer also to FIG. 3 and to FIG. 4).

Preferably, a defined clearance fit between the first slide element 56 and the guide slot 54 is present. This may involve that the orientation change of the comb 26 between the states I and II also induces a deflection of the comb 26, particularly of the link 50 which connects the first slide element 56 and the second slide element 60, refer also to FIG. 5. For illustrative purposes, the first slide element 56 is illustrated in FIG. 11 in a somewhat slanting or oblique fashion. The first slide element 56 comprises a basically rectangular shape and may be therefore also referred to as sliding carriage.

When the first slide element 56 is forced into a defined orientation at the guide slot 56, as a result, an elastic deformation of the comb 26, particularly of the coupling link 50 thereof, may be induced, e.g. due to the angular offset between the movement paths of the sliding joints 42 and 44. This may generate a contact force F which at least slightly urges the second slide element 60 into close contact with the guide ramp 58. Hence, even though the second sliding joint 44 is not arranged as a closed joint (e.g., the second slide element 60 may be basically lifted from the guide ramp 58), a defined contact is ensured, due to the internal flexing action of the adjustable comb 26. This may be achieved without the need of additional parts, using the flexibility of the adjustable comb 26.

In other words, at least at a certain movement range, the comb 26 is received at the cutting head 20 in an at least slightly over-determined fashion. Since the comb 26 is for instance made from injection-molded plastic material, the comb 26 as such is flexible or deformable in response to the (over-determined) attachment. As a result, the biasing force F is generated when the second slide element is, so to say, moved away from the path defined by the first sliding joint 42.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A length adjustment mechanism for an adjustable comb for a hair cutting appliance, the length adjustment mechanism comprising:

a first sliding joint defining a first movement direction;

a second sliding joint defining a second movement direction, wherein the first movement direction and the second movement direction are linear paths, and wherein the first movement direction and the second movement direction are arranged in a non-parallel fashion in such a way that a coupling link engaging the first sliding joint and the second sliding joint is guided between a first position and a second position for a combined longitudinal and swiveling movement therebetween.

2. The length adjustment mechanism as claimed in claim 1, comprising a pair of first sliding joints and a pair of second sliding joints, and wherein respective ones of the first sliding joints and the second sliding joints are arranged at a first lateral side and a second lateral side of a cutting head of the hair cutting appliance.

3. The length adjustment mechanism as claimed in claim 1, wherein the coupling link is attached to, or an integrally formed portion of, the adjustable comb, wherein the adjustable comb is movable by the length adjustment mechanism, between a retracted position and an extracted position, wherein a first angular setting is present in the retracted position, and wherein a second angular setting is present in the extracted position.

4. The length adjustment mechanism as claimed in claim 1, wherein the length adjustment mechanism comprises a driving slider associated with one of the first sliding joint and the second sliding joint, wherein the driving slider is configured to actuate the adjustable comb so as to define an offset between a top end of the adjustable comb and a top end of a blade set of the hair cutting appliance, wherein a driving movement of the driving slider at the first position causes a first resulting adjustment movement of the adjustable comb and the driving movement of the driving slider at the second position causes a second resulting adjustment movement of the adjustable comb, wherein the second resulting adjustment movement is larger than the first resulting adjustment movement.

5. The length adjustment mechanism as claimed in claim 1, wherein the first sliding joint has a guide slot arranged at a cutting head housing, and wherein a first slide element of the coupling link is movably received at the guide slot.

6. The length adjustment mechanism as claimed in claim 5, wherein the second sliding joint has a guide ramp arranged at the cutting head housing, and wherein a second slide element of the coupling link is movably received at the guide ramp.

7. The length adjustment mechanism as claimed in claim 6, wherein the first slide element is received in such a way at the first sliding joint that the second slide element, at least in one of the first position and the second position, contacts the guide ramp in a preloaded fashion.

8. The length adjustment mechanism of claim 7, wherein the adjustable comb is attached to the cutting head housing in a preloaded fashion.

9. The length adjustment mechanism as claimed in claim 6, wherein the first slide element is movably received at the first sliding joint, and wherein an angular displacement of the adjustable comb induces a load on the first slide element which urges the second slide element into close contact with the guide ramp.

10. A cutting head assembly for a hair cutting appliance, comprising a blade set including a movable blade and a stationary blade which are arranged to be moved with respect to one another to cut hair trapped therebetween, the cutting head assembly comprising length adjustment mechanism as claimed in claim 1.

11. The length adjustment mechanism of claim 1, wherein the first movement direction and the second movement direction are in a same plane.

12. A length adjustment mechanism for an adjustable comb for a hair cutting appliance, the length adjustment mechanism comprising:

a first sliding joint defining a first movement direction;

a second sliding joint defining a second movement direction;

a driving slider associated with one of the first sliding joint and the second sliding joint;

a driving linkage configured to operate the driving slider; and an operating lever for actuating movement of the comb, wherein the first movement direction and the second movement direction are arranged in a non-parallel fashion in such a way that a coupling link engaging the first sliding joint and the second sliding joint is guided between a first position and a second position for a combined longitudinal and swiveling movement therebetween.

13. The length adjustment mechanism as claimed in claim 12, wherein a plurality of index positions are formed at the cutting head housing, wherein the operating lever is arranged to selectively engage and disengage the index positions so as to define a respective length setting of the adjustable comb.

14. The length adjustment mechanism as claimed in claim 12, wherein a transmission rocker element is provided which is arranged between the operating lever and the driving slider, wherein the transmission rocker element is pivotably arranged at the cutting head housing, wherein a transmission joint is formed between the transmission rocker element and the driving slider, and wherein the driving slider is longitudinally moved when the transmission rocker element is pivoted.

15. The length adjustment mechanism as claimed in claim 14, wherein the operating lever is coupled with the transmission rocker element for operating the driving slider, wherein a biasing element is provided between the operating lever and the transmission rocker element, and wherein the biasing element urges the operating lever against the cutting head housing into a rest position.

16. The length adjustment mechanism as claimed in claim 12, wherein the transmission rocker element is provided with an indexing toothing, wherein a deflectable engagement element is provided, and wherein the deflectable engagement element cooperates with the indexing toothing, thereby defining an indexing rest position of the transmission rocker element.

17. The length adjustment mechanism of claim 12, wherein the operating lever is arranged as a swivel lever.

18. The length adjustment mechanism of claim 12, wherein the first movement direction and the second movement direction are linear paths.

19. The length adjustment mechanism of claim 12, wherein the first movement direction and the second movement direction are in a same plane.

20. A hair cutting appliance for being moved through hair to cut the hair comprising a housing, a cutting head, an adjustable comb, and a length adjustment mechanism for actuating the adjustable comb, wherein the length adjustment mechanism comprises:

a first sliding joint defining a first movement direction; and a second sliding joint defining a second movement direction, wherein the first movement and the second movement direction are linear paths, and wherein the first movement direction and the second movement direction are arranged in a non-parallel fashion in such a way that a coupling link engaging the first sliding joint and the second sliding joint is guided between a first position and a second position for a combined longitudinal and swiveling movement therebetween.

* * * * *